United States Patent [19]

Grothe et al.

[11] Patent Number: 4,562,967

[45] Date of Patent: Jan. 7, 1986

[54] MULTI-NOZZLE HEAD

[75] Inventors: Wolfgang Grothe, Reutlingen; Robert Weible, Dettingen, both of Fed. Rep. of Germany

[73] Assignee: Lechler GmbH & Co. KG, Fellbach, Fed. Rep. of Germany

[21] Appl. No.: 543,869

[22] Filed: Oct. 20, 1983

[30] Foreign Application Priority Data

Oct. 21, 1982 [DE] Fed. Rep. of Germany ..... 3239009

[51] Int. Cl.[4] ..... B05B 1/12; B05B 1/16

[52] U.S. Cl. ..... 239/436; 239/394; 239/396

[58] Field of Search ..... 239/394, 396, 391, 392, 239/393, 395, 390, 436, 521, 520, 171, 523, 112

[56] References Cited

U.S. PATENT DOCUMENTS 3,982,698 9/1976 Anderson ..... 239/396

4,221,334 9/1980 Christopher ..... 239/394

*Primary Examiner*—James B. Marbert

*Attorney, Agent, or Firm*—Shlesinger, Arkwright, Garvey & Fado

[57] ABSTRACT

A multiple-nozzle head to be exchangeably mounted to jet tubes, in particular of spray cleaning apparatus, comprises a cavity into which issues at the rear a feed aperture opposite to which are mounted on the front end side of the cavity several discharge apertures connected to several preferably different nozzles, at least one freely moving valve sealing element being located in said cavity and by gravity can be moved in front of one of the discharge apertures, each discharge aperture receiving one valve seat, one support ring holding the valve seat, and connected thereto in the direction of flow one jet-aligner which in cross-section is preferably cross-shaped and which joins the nozzle.

The valve seat, support ring and jet-aligner form one integral component and consist either of a sintering material with wear-resistant additives (for instant PTFE compound material with addition of molybdenum-disulfide or graphite) or of a fluorinated, thermoplastically processing synthetic with wear-resistant additives (for instance with addition of molybdenum-disulfide or graphite), or of a crystalline thermoplastic based on a fluorinated polymer (for instance PVDF) or of a crystalline thermoplastic with a lubricant additive (for instance POM-M).

Such a multi-nozzle head is characterized by simple manufacture and assembly. Its size and weight can be kept relatively small.

15 Claims, 5 Drawing Figures

MULTI-NOZZLE HEAD

BACKGROUND OF THE INVENTION

The invention concerns a multi-nozzle head defined by the preambles of the claims 1–4.

The general state of the art illustratively includes the German Pat. Nos. 28 19 345 and 28 26 142.

The present invention however is based on a more specific state of the art than heretofore encountered in the practical market. Therein one valve seat, one support ring and one jet-aligner, with each element being a separate part, are provided for each of the total two or three discharge orifices in that component of the exit-part of the multi-nozzle head which contains these orifices and the nozzles connected thereto.

The individual functions of the three said elements are quite different. Thus the valve seat—which has a purely sealing function—must be adequately elastic but simultaneously as wear-resistant as possible. The support ring, on the other hand, must be exclusively supporting and fastening, so that strength is most important of all. The jet-aligner lastly must smooth the flow toward the nozzle exit. The jet-aligner is used to reduce turbulence in order to achieve a quiet and stable jet profile and also to achieve a more uniformly spread jet and a higher jet strength.

Because of the above-stated very different requirements placed on the three elements of valve set, support ring and jet-aligner, they have been designed heretofore as separate parts and have been made of different materials meeting the specific demands imposed. Thus it is known to make the valve seat of plastic, the support ring of metal, and the jet-aligner also of metal.

As a result disadvantageous high costs are incurred in manufacture and assembly. Further drawbacks in the separate design and manufacture of the said parts include the higher weight and larger size of the multi-nozzle head.

OBJECT OF THE INVENTION

It is the object of the present invention to so design a multi-nozzle head of the species stated in the preambles of the claims 1,2,3 and 4 that simpler manufacture and assembly with simultaneous reduction of the size and total weight will be possible.

The proposed solution of this problem by the invention is stated in the alternative solutions of the characterizing parts of the claims 1, 2, 3 and 4.

Because of the integral design of the elements, namely the valve seat, the support ring and the jet-aligner, one obtains on one hand simpler manufacture because the alternative solutions provide by the claims 2, 3 and 4 permit the integral component to be formed by casting or injection molding.

On the other hand, in the case of the alternative solution of claim 1, the integral component is formed appropriately by pressing or sintering.

The materials of the invention are characterized by such a molecular structure that on one hand they evince an adequate creep or flow behavior (which is important for sealing), and on the other hand adequate stability (which is important for support and for wear-resistance).

Advantageously, the invention also makes possible a simpler assembly of the multi-nozzle head.

Because of the integral design of the valve-seat, support-ring and jet aligner, a lesser outside diameter and a bigger inside diameter of the integral component will be achieved than would be possible for the separately designed three elements. The smaller outside diameter makes possible a correspondingly smaller outside diameter of the connected nozzle. The larger inside diameter in turn makes possible larger clear cross-sections and hence less susceptibility to clogging. The flow rate becomes less, whereby turbulence can be greatly reduced and hence more uniform jet distribution and higher jet strengths can be obtained. (Higher jet strengths are especially desired in high-pressure cleaning apparatus, whereas more uniform jet spreading becomes more significant in other applications).

Furthermore, the invention provides a shorter total length of the component valve-seat/support-ring/jet-aligner and hence less outside lengths of the entire multi-nozzle head than would be possible for a separately designed assembly of the valve seat, support ring and jet aligner.

DESCRIPTION OF THE DRAWINGS

Further advantageous embodiments of the invention will be found in the dependent claims and also in the description below relating to the drawings and illustrative embodiments.

DESCRIPTION OF THE INVENTION

Figure 1:
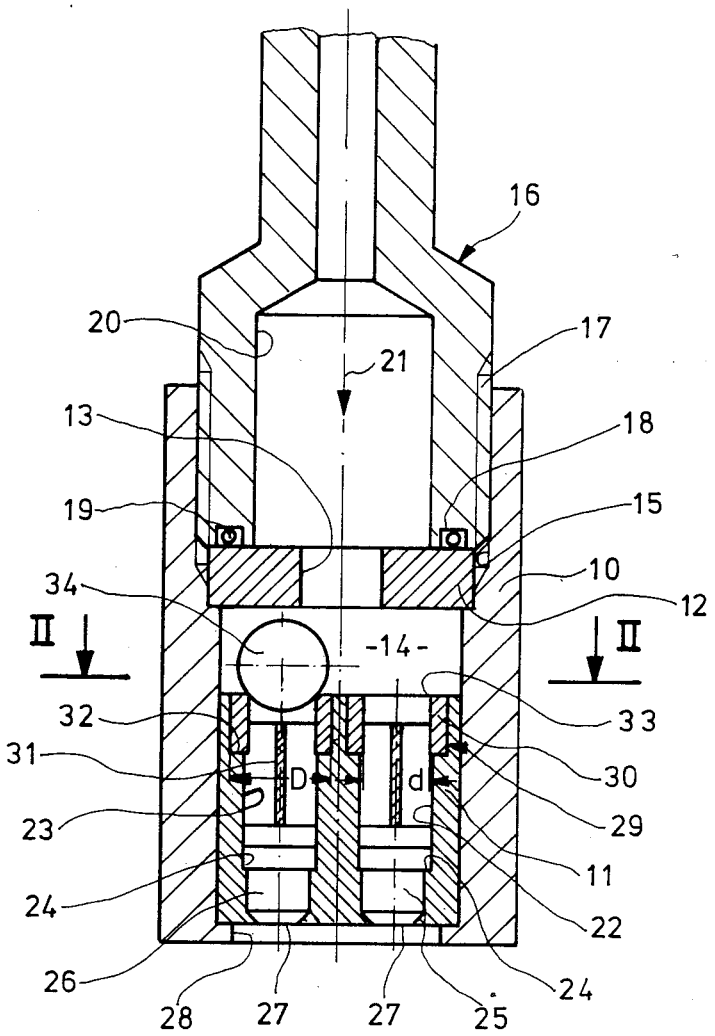
FIG. 1 is a vertical lengthwise section of a multinozzle head.

FIG. 1 shows the housing 10 of a multi-nozzle head. A nozzle insert 11—for instance of a metallic material—is mounted at the front end of the housing 10, which is the lower end as viewed in FIG. 1. A closure part 12 provided with a central passageway 13 is mounted within the housing 10. A cavity 14 is formed within the housing 10 which is bounded, on one hand, by the nozzle insert 11 and, on the other hand, at the end by the closure part 12.

As further shown by FIG. 1, the housing 10 is provided at its rear end with an inside thread 15 into which is screwed a connector means 16 by its outside thread 17. The connector means 16, for instance, may be the front end of a steel tube, for instance of a high-pressure cleaning apparatus. The connector part 16 is provided at its front end with a milled annular groove 18 receiving a sealing ring 19 made of an elastic material. The connector part 16 feeds liquid to a multi-nozzle head and to that end is provided with a central liquid feed bore 20 flaring in the direction of flow from an initially lesser diameter into a larger one. The liquid feed bore 20 is arranged coaxially to the liquid passageway 13 in the closing part 12. The already mentioned sealing ring 19 seals the butt ends of the parts 16 and 12.

The liquid fed to the cavity 14 leaves through nozzle insert 11 disposed at the front end of the housing 10. For that purpose, the nozzle insert 11 is provided with two cylindrical discharge orifices 22 and 23. (However three discharge orifices may also be provided). A nozzle 25 and 26 is exchangeably mounted into the discharge orifices 22 and 23 resp. which are stepped at 24. The nozzles 25 and 26 can be of different designs regarding jet shapes, flow rate and the like. The nozzle discharges 27 communicate with circular passageway 28 of the housing in such a manner that the liquid flowing from the nozzles 25 and 26 arrives unhampered in the open.

In the rearward direction, the nozzles 25 and 26 are joined to an integral component denoted as a whole by 29. The integral component 29 combines the following elements: one valve seat, one support ring and one jet aligner. The valve seat and the support ring are annular in shape and are denoted by 30 as a whole. The cross-sectionally cross-shaped jet-aligner is shaped onto the annular part 30 and denoted by 31. The lower part of the annular part 30 acting as the support ring rests on an offset 32 of the nozzle insert 11. The integral component 29 acts as a valve seat at its upper inner rim 33. Thereby, it cooperates with spherical valve body 34 mounted in freely movable manner within the cavity 14 of the housing 10. In the embodiment of FIG. 1, the spherical valve body 34 seals the discharge aperture 23 and hence blocks the liquid from being fed to the nozzle 26.

To assure problem-free operation of all the elements of the integral component 29, the material of which it is made not only must provide adequate creep or flow behavior (which is important for the sealing at 33), but also it must evince adequate strength to fully meet its support function at 32. Furthermore the integral component 29 must be highly resistant to wear. Several groups of material were found which meet these requirements. Thus, the integral component 29 might be manufactured from a plastic/sintering-material with wear-resistant additives, by pressing and sintering. An applicable material, for instance, is a PTFE compound material with additives of molybdenum-disulfide or graphite.

However, it is also possible to make the integral component 29 from a fluorinated, thermoplastically processed synthetic with wear-resistant additives. Again, the most applicable wear-resistant additives are molybdenum-disulfide or graphite.

Furthermore, the integral component 29 may be made of a crystalline thermoplastic based on a fluorinated polymer. This will preferably be PVDF (Polyvinylidene-fluoride).

However, the above requirements are also met by a crystalline thermoplastic with lubricant additives. Most of all, POM-M (polyacetal with molybdenum-disulfide additive) is applicable. Other possible materials within the above category are PPS (polyphenylene sulfide) or PP (polypropylene reinforced by molybdenum disulfide).

Where thermoplastically processed materials are used, the integral component 29 appropriately will be made as a cast or injection-molded article. This permits simple and economical manufacture of the integral component 29.

The integral design of the component 29 makes it possible to keep the outside diameter denoted by D of the annular part 30 relatively small and at the same time to make the inside diameter d of the annular diameter 30 relatively large. Thereby, the total diameter of the multi-nozzle head, including the nozzle housing 10, is reduced, and, on the other hand, larger clear nozzle cross-sections can be obtained, hence the device is less susceptible to clogging, and therefore also requires lower flow rates. Accordingly, the integral design of the component 29 acts to provide a more uniform jet distribution and achieves higher jet strengths.

Figure 2:
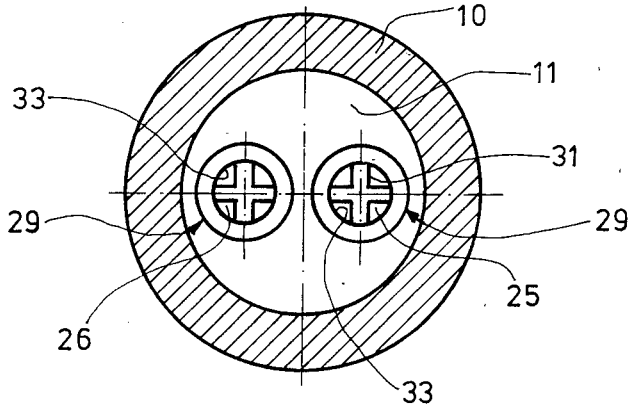
FIG. 2 is a section along line II—II of FIG. 1.
Figure 3:
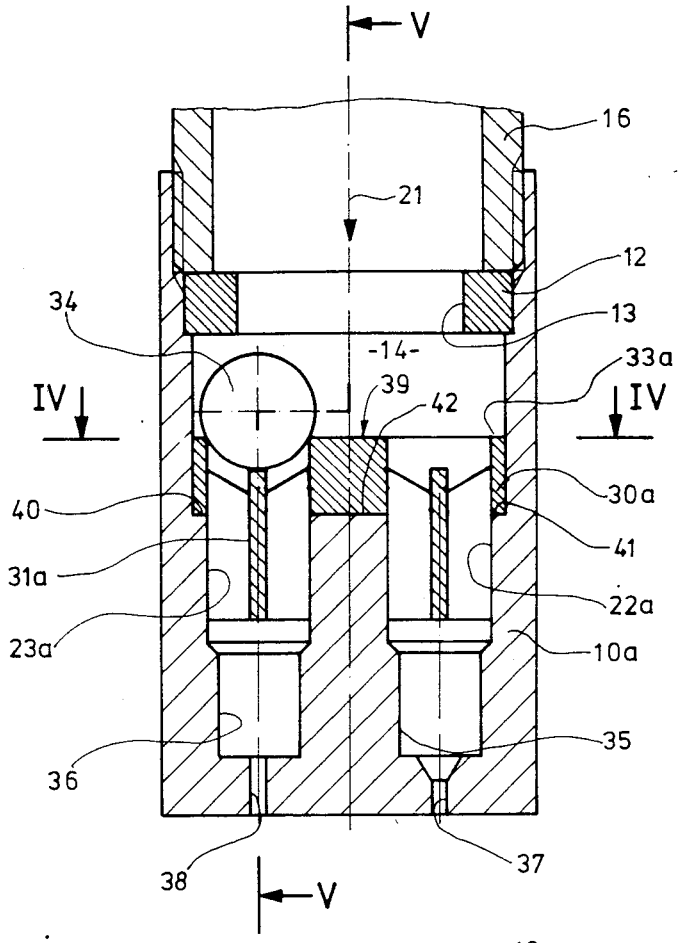
FIG. 3 is a section corresponding to FIG. 1 (section III—III in FIG. 5) of another embodiment of a multinozzle head.
Figure 4:
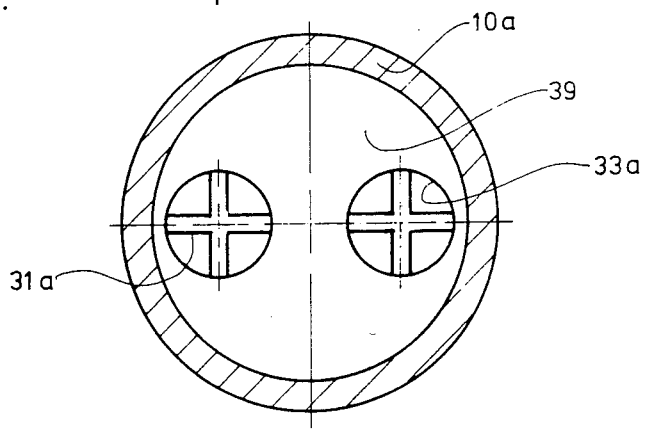
FIG. 4 is a section along the line IV—IV of FIG. 3, and, FIG. 5 is a section along line V—V of FIG. 3.
Figure 5:
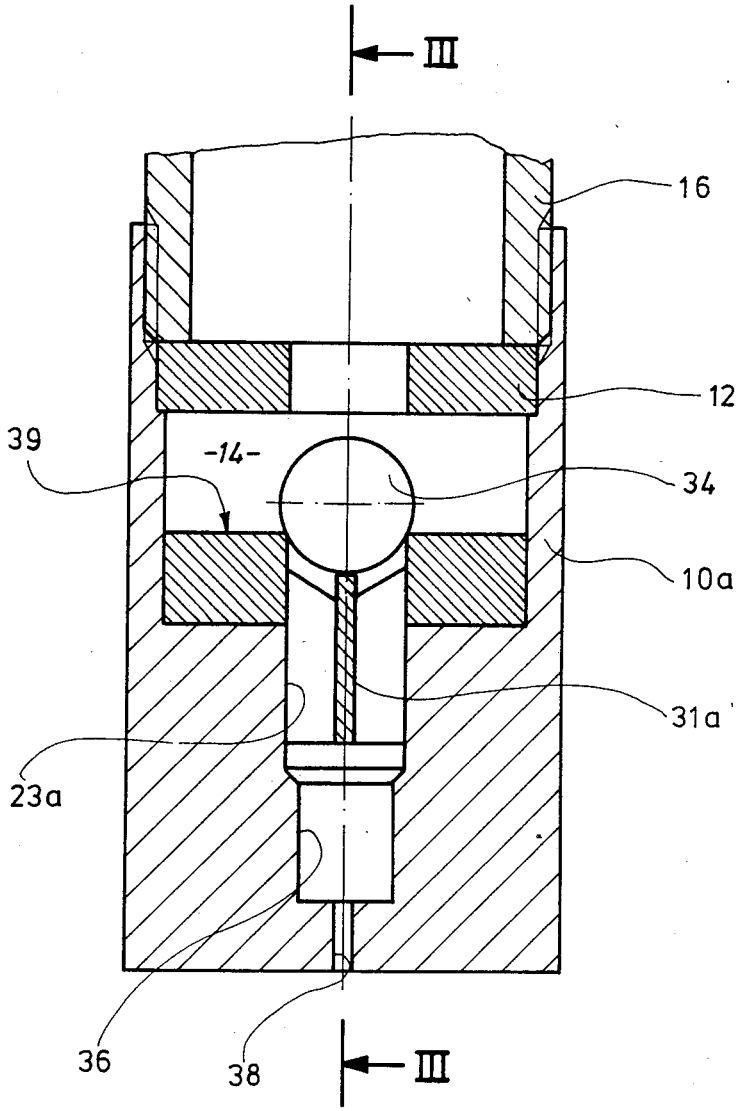

The embodiment of FIGS. 3–5 differs from that of FIGS. 1 and 2 on one hand in that in FIGS. 3–5 the nozzles denoted therein by 35 and 36 and their nozzle discharges 37 and 38 resp. are directly fashioned into the housing 10*a* of the multiple head nozzle. A nozzle insert such as is provided in FIGS. 1 and 2 and denoted there by 11 is eliminated in the embodiment of FIGS. 3–5. As regards the embodiment of FIGS. 3–5 the two discharge apertures 22*a* and 23*a* are also fashioned directly into the material of the housing 10*a*.

A further and very significant difference in the embodiments of FIGS. 3–5 when compared with the FIGS. 1 and 2 is that the discharge apertures 22*a* and 23*a* do not have a separate integral component with valve seat 33*a*, support ring 30*a* and jet aligner 31*a*, rather, these parts are combined as one integral component denoted by 39. The integration of the valve-seat, support ring and jet-aligner elements therefore goes beyond the embodiment of FIGS. 1 and 2. The integral component 39 rests at 40, 41 and 42 in the housing 10*a*.

Furthermore the embodiment of FIGS. 3–5 is characterized by the feature of the individual ribs of the jet-aligners 31*a*, which as in the embodiment of FIGS. 1 and 2 are cross-sectionally like a cross, each sloping from the rim to the center in the direction of the flow 21. Thereby, the strength of the valve seat, ie the support-ring function, is assured even more.

However, note must be made that the overall integral design of the component 39 of FIGS. 3–5 is basically conceivable also when the multi-nozzle head of FIGS. 1 and 2 is used, that is when arranging a set of nozzles 11 and separate exchangeable nozzles 25, 26. Again, the separate design of the embodiment of the integral components 29 of FIGS. 1 and 2 can be provided in a multi-nozzle head of FIGS. 3–5, that is without an insert 11 and with the nozzles 35, 36 directly worked into the housing 10*a*.

We claim:

1. A multi-nozzle head to be exchangeably mounted on jet tubes, in particular in spray cleaning apparatus, with a cavity into which issues at the rear a feed aperture opposite which are arranged, at the front end side of this cavity, several discharge apertures to which are connected preferably different nozzles, at least one freely moving generally spherical valve sealing element being located in said cavity that on the basis of gravity can be moved in front of one of the discharge apertures, each discharge aperture being provided with one valve seat, a support ring holding said valve seat, and, as seen in the direction of flow, a joining jet-aligner preferably with the cross-sectional shape of a cross and connected to the nozzle, characterized in that the valve seat (33), the support ring (30) and the jet-aligner (31) form one integral component (29 or 39) and consist of a sintering material with wear-resistant additives, preferably of a PTFE compound material with an additive of molybdenum-disulfide or graphite.

2. A multi-nozzle head to be exchangeably mounted on jet tubes, in particular of spray cleaning apparatus, with a cavity into which issues at its rear a feed aperture opposite which at the front end side of the cavity are arranged several discharge apertures connected to preferably different nozzles, at least one freely moving generally spherical valve sealing element being located in said cavity and by gravity being displaceable in front of one of the discharge apertures, each of the discharge apertures comprising one valve seat, one support ring holding this valve seat, and a jet-aligner connected thereto in the direction of flow which is preferably cross-sectionally cross-shaped, which joins the nozzle, characterized in that valve seat (33), the support ring (30) and jetaligner (31) form an integral component (29, 39) and consist of a fluorinated, thermoplastically processed synthetic with wear-resistant additives, preferably an additive of molybdenum disulfide or graphite.

3. A multi-nozzle head to be exchangeably mounted on jet tubes, in particular of spray cleaning apparatus, with a cavity into which issues at the rear a feed aperture with several discharge apertures being arranged opposite said feed aperture at the front end side of the cavity and which preferably join different nozzles, at least one freely moving generally spherical valve sealing element being located in said cavity that by gravity can be moved in front of one of the discharge apertures, each of the discharge apertures being provided with one valve seat, one support ring holding this valve seat, and a jet-aligner connected thereto in the direction of flow which in cross-section is preferably cross-shaped, joining the nozzle, characterized in that valve seat (33), the support ring (30) and the jet-aligner (31) form an integral component (29, 39) and consist of a crystalline thermoplastic based on a fluorinated polymer, preferably PVDF (polyvinylidene fluoride).

4. Multi-nozzle head to be exchangeably mounted on jet tubes, in particular of spray cleaning apparatus, with a cavity into which issues at the rear a feed aperture opposite which are located, at the opposite end side of the cavity, several discharge apertures connecting to several preferably different nozzles, at least one freely movable generally spherical valve sealing element being located in said cavity which by gravity can be moved in front of one of the discharge apertures, each of the discharge apertures receiving one valve seat, one support ring holding this valve seat, and a jet-aligner connected thereto as seen in the direction of flow which in cross-section is preferably cross-shaped and which is connected to the nozzle, characterized in that valve seat (33), the support ring (30) and the jet-aligner (31) form an integral component (29, 39) and consist of a crystalline thermoplastic with a lubricant additive, preferably of POM-M (polyacetal with molybdenum-disulfide additive).

5. Multi-nozzle head per claim 2, 3 or 4, characterized in that the integral component (29, 39) is made as a cast or injection-molded part.

6. Multi-nozzle head as defined in claim 5, characterized in that each discharge aperture (22, 23) or nozzle (25, 26) is provided with an integral component (29) consisting of the valve seat (33), the support ring (30) and the jet aligner (31)—FIGS. 1 and 2.

7. Multiple nozzle-head as defined in claim 5, characterized in that an integral component (39) is provided for several or all the discharge apertures (22*a*, 23*a*) or nozzles (35, 36), the particular valve seats (33*a*) being combined in said component (39)—FIGS. 3–5.

8. Multi-nozzle head as defined in claim 7, characterized in that the ribs of the cross-shaped jet-aligners (31*a*) are sloping in each case from the rim toward the center in the direction of flow (21)—FIGS. 3–5.

9. A multi-nozzle head for mounting on a jet tube, comprising:

(a) a housing having a fluid inlet, a fluid outlet, and a bore connecting said inlet with said outlet;

(b) flow restricter means disposed in said bore intermediate said inlet and said outlet and having an aperture therethrough;

(c) said outlet including at least two juxtaposed nozzles;

(d) a chamber disposed in said bore intermediate said nozzles and said flow restricter means; and, (e) spherical valve means movably disposed in said chamber for selectively sealing one of said nozzles whereby a fluid flowing through said head may only flow through the other one of said nozzles.

10. The head as defined in claim 9, further comprising:

(a) each of said nozzles being positioned in one of a pair of juxtaposed generally cylindrical bores;

(b) each of said cylindrical bores having an inlet end and an outlet end, said nozzles positioned in said outlet end and said inlet end adjacent to and communicating with said chamber;

(c) apertured valve support means disposed in said inlet end of each of said cylindrical bore providing a sealing surface for said spherical valve means; and, (d) said valve support means including jet-aligner means extending to generally said lower end for reducing turbulence of said fluid flowing to said selected one of said nozzles.

11. The head as defined in claim 10, wherein:

(a) a nozzle insert being disposed in said bore proximate said fluid outlet;

(b) at least two discharge orifices being disposed in said insert and said orifices communicating with said chamber; and, (c) each of said nozzles being disposed in one of said orifices.

12. The head as defined in claim 11, wherein:

(a) jet aligner means being positioned in each of said orifices.

13. The head as defined in claim 12, wherein:

(a) said jet aligner means being cruciform-shaped in plan.

14. The head as defined in claim 11, wherein:

(a) an annular valve seat being disposed in each of said orifices for sealingly engaging with said spherical valve means and thereby preventing fluid flow therethrough.

15. The head as defined in claim 13, wherein:

(a) said valve means engaging said aligner means when said valve means seals said orifice.

* * * * *